US005328130A

United States Patent [19]

Gilman et al.

[11] Patent Number: 5,328,130

[45] Date of Patent: Jul. 12, 1994

[54] STABILIZER FOR A CANNON PROJECTILE

[75] Inventors: Stewart Gilman, Wharton; Anthony Farina, Hackettstown, both of N.J.

[73] Assignee: The United States of America as represented by the Secretary of the Army, Washington, D.C.

[21] Appl. No.: 32

[22] Filed: Jan. 4, 1993

[51] Int. Cl.[5] ..... F42B 10/26

[52] U.S. Cl. ..... 244/3.23; 102/439; 102/517; 244/3.3

[58] Field of Search ..... 244/3.23, 3.24, 3.25, 244/33; 102/372, 373, 473, 501, 517, 524, 526, 527, 439

[56] References Cited

U.S. PATENT DOCUMENTS

| | | | |
|---|---|---|---|
| 463,922 | 11/1891 | Russell | 102/501 |
| 2,946,261 | 7/1960 | Crockett | 244/3.23 |
| 3,487,780 | 1/1970 | Troen et al. | 244/323 |
| 4,249,465 | 2/1981 | Ballmann | 244/3.23 |
| 4,682,546 | 7/1987 | Chouich | 102/501 |

FOREIGN PATENT DOCUMENTS

| | | | |
|---|---|---|---|
| 172710 | 12/1921 | United Kingdom | 244/3.23 |
| 2105445 | 3/1983 | United Kingdom | 102/529 |

*Primary Examiner*—Harold J. Tudor

*Attorney, Agent, or Firm*—Anthony T. Lane; Edward Goldberg; Michael C. Sachs

[57] ABSTRACT

A cylindrical device connected to the nose of a projectile for imparting spin to the projectile fired from a non-rifled bore of a cannon. The device has at least two coaxial, adjacent, and integrally connected cylindrical segments of different diameter. The segment having the larger diameter is positioned most rearwardly of the projectile, relative to the nose of the projectile, and the periphery of this segment has circumferentially spaced angled slots for catching air moving past the projectile to spin the projectile. The segment with the smaller diameter attaches the cylindrical device to the aft end of the nose of the projectile and directs the flow of air to and through the angled slots of the segment having the larger diameter.

9 Claims, 3 Drawing Sheets

STABILIZER FOR A CANNON PROJECTILE

The invention described herein may be manufactured, used and licensed by or for the Government for Governmental purposes.

FIELD OF THE INVENTION

This invention relates to a device for a projectile, or a portion of a projectile for effecting spin of the projectile in flight, after the projectile is fired from a smooth bore cannon.

BACKGROUND OF THE INVENTION

In the science of ballistics, it is conventional wisdom that shock waves, emanating from a projectile in flight and traveling faster than the speed of sound, interfere with and break-up the flow of air close to the aft or back end of the projectile. The disruption of air flow affects the flight of the projectile. In order to compensate for or overcome such perceived interference and to impart spin to a projectile fired from a non-rifled or smooth bore system, the projectile 120, as shown in prior art FIG. 1*a*, is manufactured to include a boom or extension 122 which provides distance between the nose 124 and fins 126. In effect, the boom ensures that the fins, which do not extend beyond the diameter of the body of the projectile, will contact intact air flow.

Alternatively, a projectile, as shown in FIG. 1*b* may have expanding fins 128. In such a case, the fins are hinged and spring loaded to the body of the projectile so that as the projectile exits the bore of a cannon on firing, fins 128 expand beyond the caliber or diameter of the body of the projectile to engage intact air flow causing the projectile to spin.

The prior art projectiles may have an ogive or rounded nose 124 as shown in FIGS. 1*a* and 1*b* or a spine nose discussed infra.

The structures described above add expense to the manufacture of the projectile and may require movable parts that are subject to failure, as in the case of the expanding fins of FIG. 1*b*.

It has now been found that the device of the present invention, having a diameter no greater than the diameter of the projectile to which it is attached, and which can be attached at the aft end of the projectile, can successfully use the air flow near the aft end of the projectile to spin the projectile. Accordingly, the invention eliminates the need for a "boom" or expandable spring loaded fins.

SUMMARY OF THE INVENTION

The present invention relates to a cylindrical device for imparting spin to a projectile fired from a non-rifled tube of a cannon. The device has at least two coaxial, adjacent, and integrally connected cylindrical segments of different diameter. The segment having the larger diameter is positioned most rearwardly of the projectile, relative to the nose of the projectile, and the periphery of this segment has circumferentially spaced angled slots for catching air moving past the projectile to spin the projectile. The segment with the smaller diameter attaches the cylindrical device to the aft end of the projectile and directs the flow of air to and through the angled slots of the segment having the larger diameter.

DETAILED DESCRIPTION OF THE INVENTION

Figure 1A:
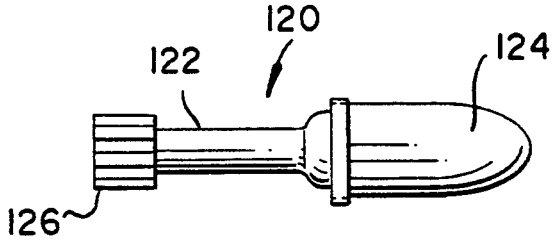
PRIOR ART FIG. 1a
FIG. 1*a* shows a prior art projectile having an extended boom and fins attached to the rear of the boom; neither the diameter of the boom, nor the length of the fins extend beyond the caliber or largest diameter of the projectile.
Figure 1B:
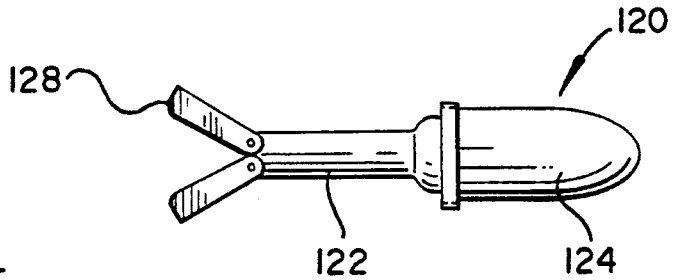
PRIOR ART FIG. 1b
FIG. 1*b* shows a prior art projectile having expanding spring loaded fins that extend beyond the largest diameter of the projectile.
Figure 5:
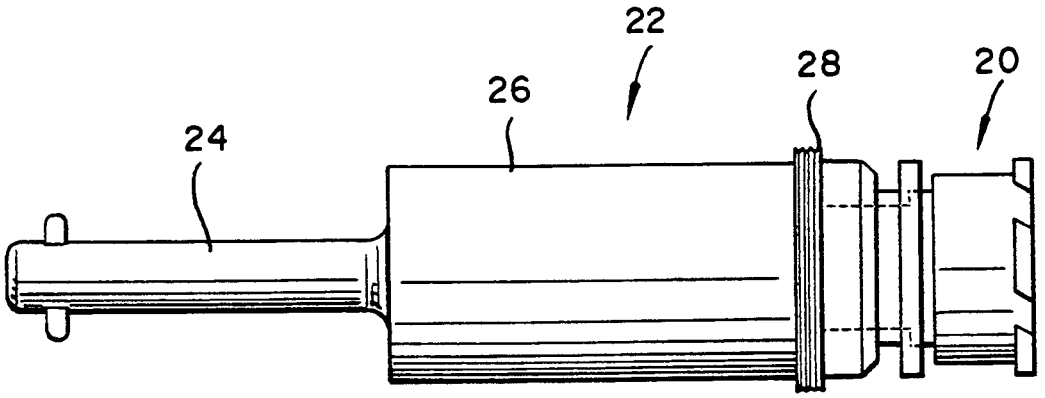
FIG. 5 shows a projectile having a spine-shaped nose with the stabilizer of the invention connected to the rearward end of the projectile thereof.

The stabilizer 20 of the invention is shown in FIG. 5 attached to the rearwardmost (tail) end of a projectile 22. Projectile 22 may be, for example a tank round for a 120 mm smooth bore system. Stabilizer 20 ensures that the projectile spins when fired from such a smooth bore or non-rifled system. Projectile 22 possesses a spine nose forwardmost (front) portion 24 and a rearward or aft cylindrical portion 26 having stabilizer 20 attached thereto. The diameter of cylindrical portion 26 is slightly smaller than the inside diameter of the bore of tube from which the projectile is fired. Obturator 28, fastened about the cylindrical portion of the projectile provides a friction fit between the bore of the cannon and projectile to prevent forward thrust gasses from escaping from the bore prior to the escape of the projectile when fired. The projectile and the stabilizer have a common longitudinal axis 29 (see FIG. 2).

Figure 2:
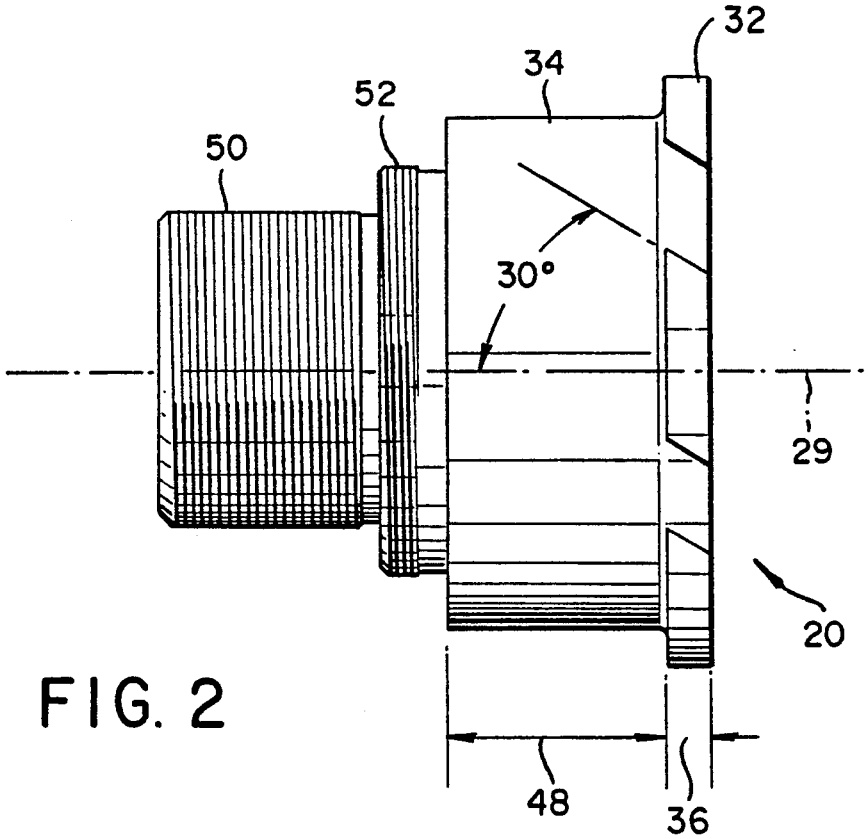
FIG. 2 shows a side view of the stabilizer of the invention.

FIG. 2 shows a side view of stabilizer 20. The stabilizer as shown is cylindrical having two distinct diameters and a single longitudinal axis 29. For simplicity, stabilizer 20 can be characterized by two integrally connected, adjacent and coaxial cylindrical segments 32 and 34. Segment or flange 32 has a diameter slightly smaller than the inner diameter of the bore of the cannon from which the projectile is fired. That is, the diameter of segment 32 is equal to, or substantially equal to, the diameter of the largest cylindrical portion of the projectile. For instance, if the projectile is for a 120 mm smooth bore system, the largest cylindrical portion of projectile 22 (other than obturator 28) has a diameter of approximately 119.3 mm, which is substantially the dimension of the diameter of cylindrical segment 32.

Unless stated otherwise, any dimension recited herein is a dimension for a 120 mm smooth bore system.

Segment 32 has an axial length 36 of approximately 10.1 mm, and the periphery 37 (shown more clearly in FIG. 4) of segment 32 has equally spaced, circumferentially positioned, angled slots 38 or air flow-through channels, which traverse the length of segment 32. The peripheral arrangement of the slots is shown more clearly in FIG. 3. As more clearly shown in FIG. 4, angled slots 38 are defined by substantially parallel side walls 40 separated by a surface 42 which is either planar or arcuate shaped. The slot width 43, or more accurately the perpendicular distance between slot walls, is approximately 18.1 mm. As shown, side walls 40 are negatively sloped, relative to the longitudinal axis 29 of segments 32 and 34, creating angled slots 38.

Figure 3:
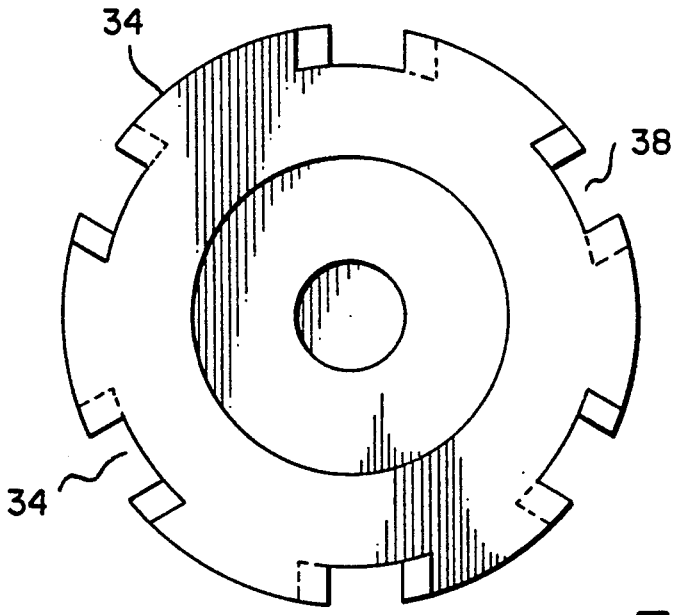
FIG. 3 shows a front view of the stabilizer of FIG. 2.
Figure 4:
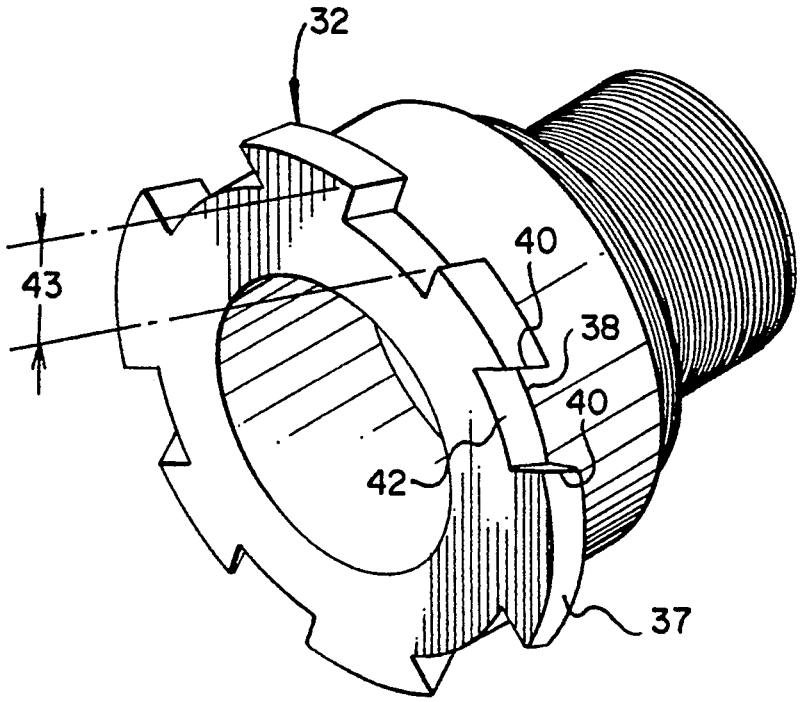
FIG. 4 is a perspective view of the stabilizer more clearly showing slots on the periphery of the segment of the stabilizer having the largest diameter.

As shown in FIG. 3, the stabilizer for a 120 mm caliber projectile has six circumferentially, equally spaced apart angled slots 38 which are positioned equiangularly, i.e., every sixty degrees about the periphery 37 of segment 32 with slot walls 40 being angled at thirty degrees relative to longitudinal axis 29 (FIG. 2).

The number of angled slots 38 is not critical, as long as the number is greater than one and the slots are positioned symmetrically about periphery 37; nor is the angle of slot walls 40, relative to the longitudinal axis of stabilizer 20, critical as long as the angle is between zero and ninety degrees. Preferably, the angle is between fifteen and seventy-five degrees and most preferably, for the 120 mm caliber system, the angle is thirty degrees. It has been determined that the number of slots on the stabilizer is directly proportional to the time required for a projectile to reach a steady state, i.e., a constant rate of spin, and the angle of the walls determines the spin rate. The projectile shown in FIG. 5 having stabilizer 20 attached thereto with six equally spaced apart slots 38 and slot walls 40 angled at thirty degrees, relative to the longitudinal axis 29 of the segments 32 and 34, and traveling faster than the speed of sound, will spin at a rate of twenty-five revolutions per second. The steady state is reached in seconds.

Adjacent, integrally connected, and coaxial to cylindrical section or flange 32 is cylindrical section 34. Cylindrical section 34 has a diameter smaller than the diameter of cylindrical section 32 and an axial length 48 longer than the axial length 36 of cylindrical section 32. The diameter of cylindrical section 34 is approximately 102.6 mm, and the axial length 48 is approximately 43.6 mm. The difference in diameters between cylindrical segments 32 and 34 defines the depth of slots 38.

A threaded member 50, the diameter of which is not critical, so long as it is not greater than the diameter of cylindrical segment 34, is attached to segment 34 and connects stabilizer 20 of the invention to a complimentary connecting member, not shown, of projectile 22. Member 50 alternatively may be a bayonet mount (not shown) and member 50 additionally may include, as shown in FIG. 2, auxiliary ring clamp threads 52 for mating with a ring clamp of a projectile.

As described above, the device can be connected to the rear end of either a spine-nosed 24 (FIG. 5) or ogive-nosed shaped projectile and may be made in dimensions to fit a projectile of any smooth bore system. In operation, as a projectile exits the bore of the non-rifled cannon, above the speed of sound, air passes over axial length 48 of reduced diameter cylindrical segment 34 and is directed through angled slots 38 on the periphery 37 of cylindrical segment 32. As shown in FIG. 2, the walls 40 of slots 38 have a negative slope and as air passes through slots 38 the projectile 22 spins in a clockwise direction (when viewed from the rear). Reversing the slope of the walls 40 will force the projectile to rotate in the counter clockwise direction.

The device reaches a steady state or a constant spin rate in a matter of seconds, and this spin rate is accomplished by reducing the conventional length of a prior art projectile without the need for fins extending beyond the diameter of the projectile. The device as described may be machined from a solid piece of aluminum or other light and malleable metal. Slots may be cut into the metal using a router bit.

It should be apparent that many modifications may be made to the invention without departing from the spirit and scope of the invention. Therefore, the drawings, and description relating to the use of the invention are presented only for the purposes of illustration and direction.

What is claimed is:

1. A supersonic projectile, to be fired from a non-rifled tube, comprising a stabilizer to impart an accuracy enhancing, stabilizing spin, during flight, said projectile comprising:

a nose section and a stabilizer coaxially connected thereto, said nose section having a longitudinal axis, a forward end and a cylindrical aft end, and the largest diameter thereof being slightly smaller in diameter than the inner diameter of the non-rifled tube of the cannon, an obturator ring mounted on an aft portion of the nose section;

said stabilizer consisting of a one piece solid metal element and being cylindrical and having first and second unequal diameters defining at least two coaxial first and second adjacent sections, said first section of said stabilizer being connected to the aft end of the nose section of the projectile and having a diameter smaller than the diameter of said largest diameter of the nose section, said second section, located at an aft end of the stabilizer having a diameter substantially equal to said largest diameter of the nose section, said second section defining a circumferential periphery and a plurality of angled slots circumferentially spaced apart on the periphery, said slots being defined by opposing spaced apart parallel flat side walls, said side walls being angled relative to the longitudinal axis, whereby air striking such walls during flight forces said spin to be imparted to said projectile.

2. The projectile of claim 1 wherein the slots have a depth defined by the difference between the diameters of the two adjacent segments.

3. The projectile of claim 1 wherein the angle between the longitudinal axis of the segments and the side walls of the slots is between about 15 and 75 degrees.

4. The projectile of claim 1 wherein an axial length of the first cylindrical segment is longer than the axial length of the second cylindrical segment.

5. The projectile of claim 1 wherein six angled slots are equally spaced about the periphery of the second segment.

6. The projectile of claim 5 wherein the angle between the longitudinal axis of the segments and the side walls of the angled slots is about 30 degrees.

7. The projectile of claim 1 wherein means for coaxially connecting the stabilizer to a nose of the projectile is a threaded member for engaging a complementary threaded member of the nose.

8. The projectile of claim 7 wherein an axial length of the first cylindrical segment is longer than the axial length of the second cylindrical segment.

9. The projectile of claim 1 wherein an axial length of the first cylindrical section of the stabilizer is longer than the axial length of the second cylindrical section, and said plurality of slots are symmetrically positioned on the periphery of the second section.

* * * * *